United States Patent [19]

Caruso

[11] 4,111,822

[45] Sep. 5, 1978

[54] GREASE COMPOSITIONS

[75] Inventor: Gerard P. Caruso, New Orleans, La.

[73] Assignee: Shell Oil Company, Houston, Tex.

[21] Appl. No.: 839,153

[22] Filed: Oct. 3, 1977

Related U.S. Application Data

[63] Continuation of Ser. No. 751,765, Dec. 16, 1976, abandoned.

[51] Int. Cl.[2] ..... C10M 1/32; C10M 3/26; C10M 5/20; C10M 7/30

[52] U.S. Cl. ..... 252/51.5 A; 252/392

[58] Field of Search ..... 252/51.5 A, 392

[56] References Cited

U.S. PATENT DOCUMENTS

| | | | |
|---|---|---|---|
| 3,868,329 | 2/1975 | Brown et al. | 252/51.5 A |
| 3,868,330 | 2/1975 | Meinhardt et al. | 252/51.5 A |
| 3,947,367 | 3/1976 | Foelsch et al. | 252/51.5 A |

*Primary Examiner*—Irving Vaughn

[57] ABSTRACT

Grease compositions containing a polyurea grease thickener and certain acylated alkylene polyamines are disclosed.

3 Claims, No Drawings

GREASE COMPOSITIONS

This is a continuation of application Ser. No. 751,765, filed Dec. 16, 1976 and now abandoned.

BACKGROUND OF THE INVENTION

The requirement that grease compositions provide adequate lubrication at high temperature for extended periods of time has become increasingly important. For this reason, grease compositions containing a variety of organic thickening agents, such as those containing multiple uriedo or urea functional groups, have been developed. For example, U.S. Pat. Nos. 3,242,210; 3,243,372 and 3,401,027 disclose polyurea grease thickeners obtained by reacting a three component reactant mixture comprising a monoamine, a diamine and a diisocyanate, or a monoisocyanate, a diisocyanate and a diamine. As a general rule, the reaction product is comprised of a mixture of urea-containing species of varying chain length and urea content. However, by careful control of reaction variables such as, e.g., the relative quantities of reactants employed, the reaction temperature and the rate and order to reactant mixing, a product may normally be obtained which predominates in one polyurea species. The polyurea reaction is preferably carried out in situ in the grease carrier, and the reaction is product may be utilized directly as a grease thickener.

While greases thickened with polyurea thickeners are in many respects superior to older lubricants in severe service application, especially with regard to maintenance of grease consistency at high temperatures, such greases suffer several disadvantages which limit their usefulness under practical service conditions. For example, while polyurea thickened greases show excellent retention of mechanical properties at high temperature (70° C. or above) and high or low shear, they tend to soften considerably when subjected to low shear at ambient temperature ranges (20°-30° C.). In fact, the tendency to soften at ambient temperature under low shear can be so great that the grease can, when subject to mechanical working under these conditions, undergo a change in penetration grade, e.g., from a No. 2 NLGI penetration grade to a No. 1 NLGI penetration grade. This change in penetration grade at ambient temperature under low shear is particularly troublesome since it may occur under practical use conditions when the grease is transferred from the original shipping container or is otherwise stirred or handled. Consequently, normal handling of the grease in making it available to the ultimate consumer may change its consistency to such extent that it is no longer the desired penetration grade for the intended application. While it is true that the change in consistency is reversible, in that the softened grease can be subjected to high shear at high temperatures (conditions used in the original grease preparation) to return the grease to its original consistency, this reversal often requires that the softened grease be shipped back to the formulator for reprocessing.

Additionally, neat polyurea thickened greases demonstrate poor ability to inhibit rust formation, especially where lubricant service is required in corrosive environments. While additives have been proposed to overcome this problem, many conventional rust inhibitors adversely effect other desirable grease properties. For example, some additives cause the grease to soften, or function only as rust inhibitors (U.S. Pat. No. 3,868,329), thereby necessitating the use of other additives for a fully formulated grease package.

Accordingly, a need has existed for the development of a polyurea grease formulation containing a multipurpose additive which enhances the mechanical and chemical properties of the formulated grease product. The invention satisfied that need, and provides improved polyurea grease compositions containing a multifunctional additive effective in enhancing certain mechanical and chemical properties of the grease composition.

SUMMARY OF THE INVENTION

More particularly, the invention relates to polyurea thickened grease compositions having both improved ambient temperature mechanical stability and enhanced resistance against rust formation. These compositions comprise or consist essentially of a major amount of a lubricating oil base vehicle, a polyurea gellant in an amount sufficient to thicken the base vehicle to a grease consistency and a minor amount of a specified acylated alkylene polyamine or a mixture of specified acylated alkylene polyamines. The acylated alkylene polyamines employed have the formula

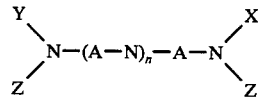

wherein A is alkylene of 2 to 4 carbon atoms and $n$ is an integer of from 0 to 3, X is H or Z, Y is selected from H, alkyl containing 12 through 22 carbon atoms, and Z, and Z is an acyl group having the formula

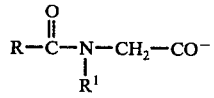

wherein R is alkyl containing 2 through 22 carbon atoms and $R^1$ is hydrogen or alkyl of 1 through 3 carbon atoms. Preferably, R contains from 12 through 22 carbon atoms.

The compositions of the invention exhibit several advantages. As indicated, they provide improved ambient temperature mechanical stability and improved rust protection. Additionally, the acylated polyamine additives increase the efficiency of the polyurea grease thickener so that less thickener is required to thicken the lubricating oil base vehicle to given penetration grade. The increase in grease yield based on the quantity of polyurea thickener employed has the secondary advantage of improving the low temperature properties of the grease because of the reduction in gellant content and concomitant increase in oil content. Other advantages accrue in that the multipurpose acylated polyamine additives of the compositions of the invention appear to act as bridging solvents in the polyurea thickened grease formulations, thereby reducing the opacity of the finished grease formulation. Again, the compositions are easily prepared. When the acylated polyamine additive is added to the other components during preparation of the polyurea grease at a point prior to the conventional high pressure homogenization of the grease, the acylated polyamine appears to act as a highly effective dispersant, allowing production of a smooth grease without going through the costly homogenization step. Finally, the grease compositions of the invention are completely ashless.

DETAILED DESCRIPTION OF THE INVENTION

The acylated alkylene polyamines employed as multifunctional additives in the polyurea thickened grease compositions of the invention, broadly speaking, are oil-soluble amides which contain at least two acyl groups per molecule. More particularly, suitable acylated alkylene polyamines may be derived from an alkylene polyamine of the formula

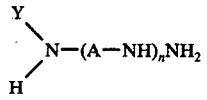

wherein A is alkylene of 2 to 4 carbon atoms, Y is alkyl containing 12 through 22 carbon atoms, and $n$ is an integer of 0 to 3. Preferred alkylene amines suitable for preparing the polyamides employed in the instant invention are alkylene amines wherein the alkylene unit, A, comprises 2 to 3 carbon atoms, and the number of alkylene amine units, $n$, is an integer from 1-3. The additives may be produced by reaction of the amine or amines with a hydrocarbyl carboxamidoalkyl acid or acids of the formula

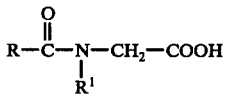

wherein R is alkyl containing 2 to 22 carbon atoms, and $R^1$ is hydrogen or alkyl of 1 to 3 carbon atoms. The multifunctional additive may be present as a single derivative of the reaction between an amine and an acid, a derivative of the reaction of an amide and more than one acid, a derivative of a mixture of amines and an acid, or a derivative of the reaction between mixed amines and mixed acids, all of the types described.

Preferred amines include ethylene diamine, propylene diamine, tallow propylene diamine, diethylene triamine, and triethylene tetramine. Particularly preferred acids include oleoyl sarcosine, lauroyl sarcosine, cocoyl sarcosine, and stearoyl sarcosine.

The acylated polyamide additives of the instant invention may be prepared by mixing one or more of the above described alkylene amines together with one or more of the acids at atmospheric pressure or greater, while simultaneously applying heat to the mixture. Generally, temperatures of from about 75° C. to about 90° C. are satisfactory, with a temperature of from about 85° C. to about 95° C. being preferred. The reactants are supplied generally in ratios of amine to acid of from 1 to 2 to 1 to 6, L preferably in ratios of from 1 to 2 to 1 to 4. Heating is continued until the reaction is essentially complete, as evidenced by cessation of water evolution from the reaction mixture.

The polyurea grease component suitable for use in combination with the multipurpose additive of the present invention may be prepared by conventional means. For example, U.S. Pat. No. 3,242,210 describes the preparation of polyurea thickened greases suitable for use in the combination of the instant invention, and its disclosure is incorporated herein by reference.

In order to insure uniform corrosion-inhibiting effectiveness and uniform hardening effect, the acylated alkylene polyamines are preferably combined with the polyurea grease after the polyurea forming reaction between the monoamine, isocyanate or diisocyanate, and diamine is complete. Addition at such a time avoids side reactions of the isocyanates in the reaction mixture with the amine functions of the additives. The additives may be incorporated at any time after the grease is thickened. For example, the additive may be supplied immediately after the polyurea reaction to enable use of a single mixing vessel, or the additive may also be added to previously prepared base greases. These base greases may include other additives, e.g., extreme pressure additives, such as sulfurized fatty oil acids, and chlorinated paraffin waxes; antioxidant additives, such as phenylalphanaphthylamine and diisooctyldiphenylamine; copper anticorrosion additives, such as 3-amino, 1,2,4-triazole; and pour point depressants such as methacrylate polymers.

The effective amount of necessary concentration of the acylated polyamide additives in the polyurea grease will depend to some extent upon which of the multipurpose properties, e.g., rust inhibition, low temperature, low shear stabilization, clarity improvement or gellant efficiency, is desired most in a given application. For general use, the acylated polyamides may be employed in concentrations of from about 0.5 percent to about 10 percent, by weight, based on the weight of the formulated grease, with from about 2 percent to about 10 percent by weight being preferred.

In order demonstrate the invention more fully, reference is made the following examples.

EXAMPLE I

A polyurea thickened base grease was prepared from the following components:

BASE POLYUREA GREASE FORMULA

| COMPONENTS | PERCENT |
|---|---|
| Toluene Diisocyanate | 4.10 |
| Tallow amine[1)] | 7.06 |
| Ethylene Diamine | 0.85 |
| 500 HVI Oil Blend | 86.99 |
| Diisooctyl diphenylamine[2)] | 0.50 |
| Phenyl- -naphthylamine | 0.50 |

[1)]Available under the tradename Armeen T from Armak Co.
[2)]Available under the tradename Vanalube 81

The above components were combined in the manner described in U.S. Pat. No. 3,242,210 and the gel formation reaction was allowed to go to completion before the inclusion of the acylated polyamine additive. Triethylene tetramine and sarcosyloleic acid were combined in a separate container and heated at about 190° C. until water no longer evolved from the reaction mixture. The acylated alkylene amine was then added to the gelled grease, and the mixture was stirred and heated at about 88° C. until the additive was uniformly incorporated. The corrosion resistance of the acylated polyamide containing grease was then tested using the modified ASTM D1743 corrosion test, described as Test B in U.S. Pat. No. 3,660,288. For this test, results are indicated by a rating, ranging from 1 to 3, reported for the compositions effect with three bearings. A grade of 1 indicates no corrosion, while a rating of 2 indicates incipient corrosion with no more than three spots of size just sufficient to be visible to the naked eye. A bearing with larger or more than three spots is rated 3. In this test the polyamide additive comprised 4 percent by weight of the grease tested. Results of the tests are as follows:

TABLE I

| ADDITIVE - AMINE/CARBOXYLIC ACID | MOLAR PROPORTION | ASTM CORROSION |
|---|---|---|
| A. Triethylene tetramine/sarcosyl-oleic acid | 1:6 | 1,1,1 |
| B. Base Grease - No polyamide | — | Fail |

As will be appreciated by those skilled in the art, the results demonstrate the effectiveness of the acylated polyamides of the instant invention as a rust inhibitor.

EXAMPLE II

One mole of triethylene tetramine (146 g) was heated at 190° C. with 6 moles (2070 g) of oleyl sarcosine until water was no longer evolved. 40 grams of the resulting amide were added to 960 grams of a polyurea grease of the same composition as employed in Example 1, and the mixture was stirred at 88° C. until the amide was uniformly incorporated into the base grease.

The grease penetration test was taken at 25° C., and Po and $P_{60}$ were found to be 179 and 216 respectively. This grease was then stirred 45 minutes at low speed at ambient temperature again to simulate low shear at low temperature, and the penetration was again taken and found to be 234 unworked and 243 worked. A comparison with the base grease is shown in the following table.

TABLE

| | A | B |
|---|---|---|
| Base grease, percent by weight | 100 | 96 |
| Triethylene tetramine, 1 mole + oleyl sarcosine, 6 moles percent by weight | None | 4 |

TABLE-continued

| | A | B |
|---|---|---|
| Original penetration, base grease $Po/P_{60}$ | 306/306 | 306/306 |
| After heating and stirring to 190° F, $Po/P_{60}$ | 297/279 | 179/216 |
| Ambient stirring 45 minutes at slow speed, $Po/P_{60}$ | 350/313 | 234/243 |

Compared to the base grease, which was exposed to the same conditions, the additive has stabilized the grease with respect to its consistency or penetration, upon exposure to ambient temperature low shear. Stated differently, the worked and unworked penetrations remain effectively the same.

I claim as my invention:

1. A grease composition comprising of a major amount of a lubricating oil base vehicle, a polyurea gellant in an amount sufficient to thicken the base vehicle to a grease consistency, and a minor amount of an acylated alkylene polyamine or mixture of acylated alkylene polyamines, the acylated alkylene polyamine or acylated alkylene polyamines having the formula

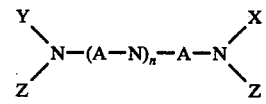

wherein A is alkylene of 2 to 4 carbon atoms and $n$ is an integer of from 0 to 3, X is H or Z, Y is selected from H, alkyl containing 12 through 22 carbon atoms, and Z, and Z is an acyl group having the formula

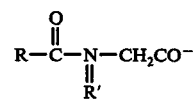

wherein R is alkyl containing 2 through 22 carbon atoms, and R′ is hydrogen or alkyl containing 1 through 3 carbon atoms.

2. The grease composition of claim 1 wherein R contains 12 through 22 carbon atoms.

3. A grease composition comprising a major amount of a lubricating oil base vehicle, a polyurea gellant in an amount sufficient to thicken the base vehicle to a grease consistency, and a minor amount of oleoyl sarcosine triethylene tetramine.

* * * * *